US005738019A

United States Patent [19]

Parker

[11] Patent Number: 5,738,019

[45] Date of Patent: Apr. 14, 1998

[54] ADJUSTABLE SHELF ASSEMBLY FOR MERCHANDISING DISPLAY STAND

[75] Inventor: Nigel Ian Parker, Harlow, United Kingdom

[73] Assignee: PPE Limited, Harlow, England

[21] Appl. No.: 596,301

[22] PCT Filed: Oct. 31, 1994

[86] PCT No.: PCT/GB94/02387

§ 371 Date: Aug. 2, 1996

§ 102(e) Date: Aug. 2, 1996

[87] PCT Pub. No.: WO95/13003

PCT Pub. Date: May 18, 1995

[30] Foreign Application Priority Data

Nov. 1, 1993 [GB] United Kingdom ..... 9322492

[51] Int. Cl.[6] ..... A47B 9/00

[52] U.S. Cl. ..... 108/108; 108/61; 211/175

[58] Field of Search ..... 108/108, 102, 108/143, 5, 60, 61; 211/175, 150; 248/242, 241, 292.11

[56] References Cited

U.S. PATENT DOCUMENTS

| | | | |
|---|---|---|---|
| 3,151,576 | 10/1964 | Patterson | 248/242 X |
| 3,667,826 | 6/1972 | Wood et al. . | |
| 4,488,653 | 12/1984 | Belokin | 108/61 X |
| 4,589,349 | 5/1986 | Gebhardt et al. | 108/102 |
| 4,602,560 | 7/1986 | Lee . | |
| 4,620,489 | 11/1986 | Albano . | |
| 4,705,175 | 11/1987 | Howard et al. . | |
| 4,776,472 | 10/1988 | Rosen . | |
| 4,934,645 | 6/1990 | Breslow | 108/108 X |
| 5,082,125 | 1/1992 | Ninni | 108/61 X |
| 5,088,607 | 2/1992 | Risafi et al. . | |
| 5,390,802 | 2/1995 | Pappagallo et al. . | |
| 5,415,297 | 5/1995 | Klein et al. | 108/61 X |

FOREIGN PATENT DOCUMENTS

| | | |
|---|---|---|
| D 176209 | 2/1986 | European Pat. Off. . |
| D 587059 | 3/1993 | European Pat. Off. . |
| 2002720 | 7/1971 | Germany . |
| 740311 | 5/1955 | United Kingdom . |

*Primary Examiner*—Jose V. Chen
*Attorney, Agent, or Firm*—Banner & Witcoff, Ltd.

[57] ABSTRACT

An extendable shelf assembly is removably mounted on the slotted uprights of a display stand and comprises a shelf mounted on a shelf support, a shelf extender attached to said shelf and the shelf support and operable so that the shelf can be extended or retracted. A manually operable locking device permits the shelf to be extended or retracted and moved from one position to another when the locking device is released, the locking device retaining the shelf in its selected position when engaged. An angularly adjustable shelf support assembly which comprises a first mounting member with structure thereon for releasably attaching the member to a slotted upright and a second mounting member for attachment to the shelf to take the load thereof. The first and second mounting members have cooperating pegs and holes thereon so the angular orientation of the second member relative to the first member can be changed and further comprises securing apparatus to hold the first and second mounting members together in their selected angular orientation.

21 Claims, 5 Drawing Sheets

ADJUSTABLE SHELF ASSEMBLY FOR MERCHANDISING DISPLAY STAND

BACKGROUND OF THE INVENTION

This invention relates to adjustable shelf assemblies for use in merchandising display stands of the type including a pair of vertically slotted spaced uprights to which the shelf assemblies can be attached at varying heights.

Various known patents disclose display stands in which the shelf assemblies includes shelves which are extendable forwardly from a retracted position to a fully extended position which permits the loading and rotation of the products to be displayed thereon. An example of such a display stand can be found in U.S. Pat. No. 4,705,175 which comprises an extendable shelf assembly adapted to be removably mounted on the slotted uprights of a merchandising display stand comprising a shelf mounted on shelf support means, shelf extending means attached to said shelf and the shelf support means and operable so that the shelf can be extended or retracted.

Whilst display stands of this type provide an improvement of those with non-extendable shelves, they suffer from the disadvantage that they are only extendable to a loading position. As a result, after loading, the shelves have to be pushed back to their display position in which the front edges of the shelves are vertically aligned so the merchandise is not displayed to its best advantage.

The Applicant realized that these merchandising display stands could be substantially improved by providing a facility for the shelves to be incrementally extended horizontally to permit the front region of each shelf to be extended to protrude slightly further than the shelf above it. This provided the significant advantage of allowing the products on each shelf to be both displayed and readily accessible to the buying public and as a result the sales through-put of the display stand could be substantially increased.

The invention is therefore characterised by providing manually operable locking means operable to permit the shelf to be incrementally extended or retracted to a selected one of several incrementally spaced positions when the locking means are released, said locking means retaining the shelf in its selected position when reengaged.

Preferably, the shelf extension means comprises at least one extendable runner assembly with a fixed member and a movable runner movably mounted thereon, the fixed member being attached to the shelf support means and the movable runner being attached to the shelf, the movable member being mounted so as to be extendable from and retractable within the fixed member.

Conveniently, the locking means is mounted on the extendable shelf and engages with the shelf support means to retain the shelf in its selected position. In a preferred embodiment, the shelf support means has a plurality of incrementally spaced detents thereon which are engageable by the locking means. The shelf support means preferably comprises a pair of spaced support arms with the spaced detents formed along the underside thereof, the locking mechanism including a movable actuator bar located underneath and adjacent the front edge of the shelf assembly and movable to disengage the locking means from the detents so that the shelf can be moved relative to the shelf support means.

In a preferred embodiment, the locking means comprises a locking bar connected to the actuator bar which is engageable with the detents, the locking bar being normally biased into engagement with the detents and extending between a pair of lever arms connected to the actuator bar, each lever arm being pivotally mounted to the adjacent movable runner intermediate its ends.

The locking bar is preferably raised to release the locking mechanism but it can be mounted so that it can be depressed or pulled towards the front edge of the shelf assembly thereby disengaging a locking peg or bar from the detent through a series of pivoted levers.

In another embodiment, the locking mechanism comprises a pivotally mounted locking lever associated with said shelf support means which is normally biased into engagement with a selected hole of a plurality of holes provided at spaced increments along the length of said shelf support means, the shelf being supported on a pair of shelf support means each having a locking lever operably associated therewith which may be operable independently of each other or they can be connected together to work in conjunction with each other. Furthermore, only a single locking lever could be used.

The main advantage of this embodiment over the earlier mentioned embodiment is that the or each locking lever can be arranged to cooperate with locking holes provided at a location above the bottom of the shelf support means. Thus, the locking means need not protrude below the shelf support means which can be an advantage if vertical access space between the shelves is limited as it means that the bottom of the locking mechanism will not catch or foul on product stacked on the shelf beneath it when the shelf is pulled out or returned during loading.

Preferably the shelf includes a front and rear rail or guide, at least one shelf divider being slidably mounted for movement along said rails or guides.

The dividers conveniently comprise a vertical wall structure which is non-adjustable in length or alternatively the divider can have a longitudinal slot which slidably receives a product support member therein.

Conveniently, the product support member is biased for movement towards the front of said divider.

The shelf support means preferably includes mounting means adapted to permit the longitudinal position of the fixed member at the runner assembly on the support means to be varied.

The mounting means can comprise a series of spaced holes or a longitudinally extending slot formed in the shelf support means. This arrangement is particularly advantageous in that it allows the shelves on a display stand to be arranged in a cascading configuration (i.e. with each shelf extending further out than the shelf above it) while still allowing each shelf to be able to be pulled out horizontally by its maximum permitted distance.

The extendable shelf assembly of the present invention preferably also includes angularly adjustable shelf support assembly comprising a first mounting member with means thereon for releaseably attaching said member to a slotted upright and a second mounting member for attachment to the shelf to take the load thereof, said first and second mounting members having cooperating pegs and holes thereon by means of which the angular orientation of the second member relative to the first member can be changed and securing means to hold the first and second mounting members together in their selected angular orientation.

In a preferred construction, a par of pegs protrude from one mounting member to cooperate with a series of holes arranged in an arc on the other mounting member, the pegs being located diametrically opposite each other and the securing means being located midway between said pair of pegs.

Conveniently, the securing means is a screw which passes through a hole in the first mounting member and is received in the second mounting member.

The first and second mounting members can be flat plates, the holes and pegs being arranged on the first and second mounting members around a central pivot axis about which the second member pivots.

Other configurations of cooperating hole and peg locating means are however envisaged. For instance, the two plates can be pivotally attached to each other and a releaseable spring loaded peg can be mounted on one of the plates for engagement in the holes in the other plate.

BRIEF DESCRIPTION OF THE DRAWINGS

A preferred merchandising stand incorporating an extendable and angularly adjustable shelf assembly will now be described, by way of example only, with reference to the accompanying drawings in which.

DETAILED DESCRIPTION OF THE INVENTION

Figure 1:
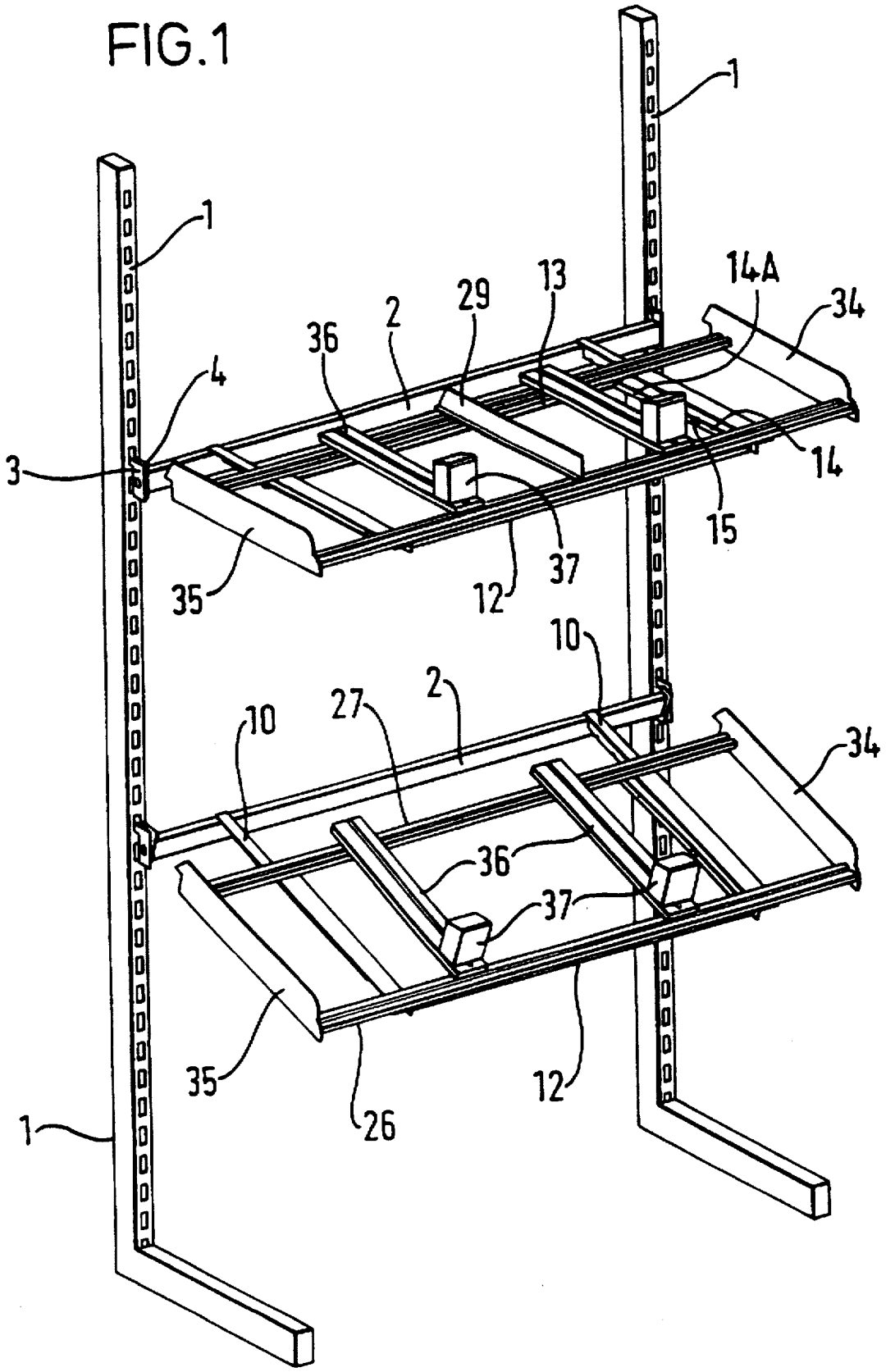
FIG. 1 is a perspective view of a merchandising display stand incorporating shelf assemblies of the present invention.

Referring to the drawings, there is shown in FIG. 1 a display stand comprising a pair of known slotted uprights 1 to which two shelf assemblies of the present invention have been fitted.

The upper shelf assembly comprises a main support section 2 extending between the two uprights 1 and having mounting means at each end and thereof by means of which the support section 2 can be attached to the uprights 1. The mounting means comprise a pair of cooperating plates 3, 4 which are better illustrated in FIGS. 2A–2F. A plate 4 is welded to each end of the main support section 2 and is provided with a pair of diametrically opposed pegs 5 protruding outwardly therefrom. An outer plate 3 with a hook section 1B fits into and is received by slots 1A in the upright 1. The plate 3 has a hole located centrally in it which receives a screw 8 to secure the outer plate 3 to the inner plate 4. The outer plate 3 is provided with a series of holes 6 arranged in an arc around the central screw 8 and pegs 5 cooperate and fit into these holes 6. It will be noted that the pegs 5 fit into the holes 6 located diametrically opposite each other about the central screw 8.

Figure 2A:
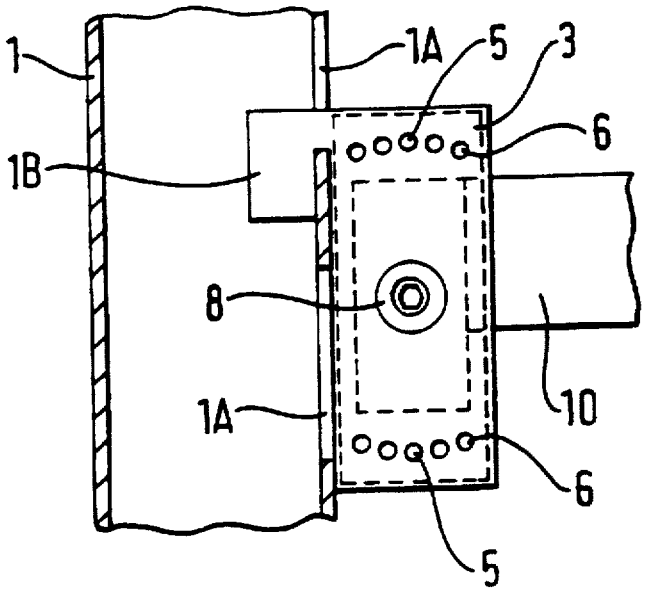
FIGS. 2A–2F are various views of the angular shelf adjustment mechanism used in the shelf assemblies shown in FIG. 1.
Figure 2B:
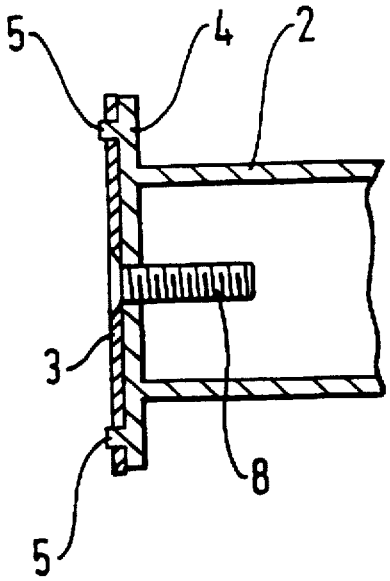
Figure 2C:
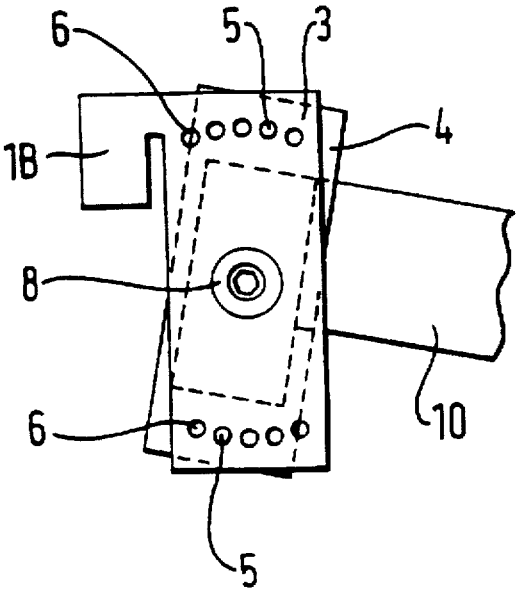
Figure 2D:
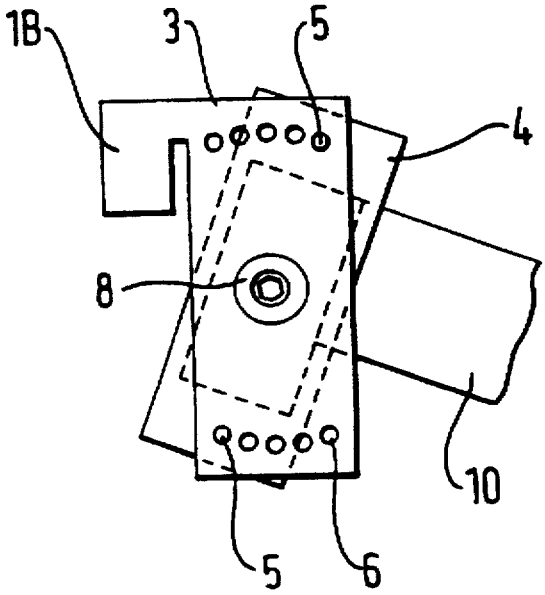

As can be seen more clearly in FIGS. 2C and 2D, on release of the screw 8, the pegs 5 can be disengaged from the holes 6 in the outer plate 3 and the angle of the shelf support member 10 can be varied by fitting the pegs 5 into a different pair of diametrically opposed holes 6 and then secured in position by retightening the screw 8.

Figure 2F:
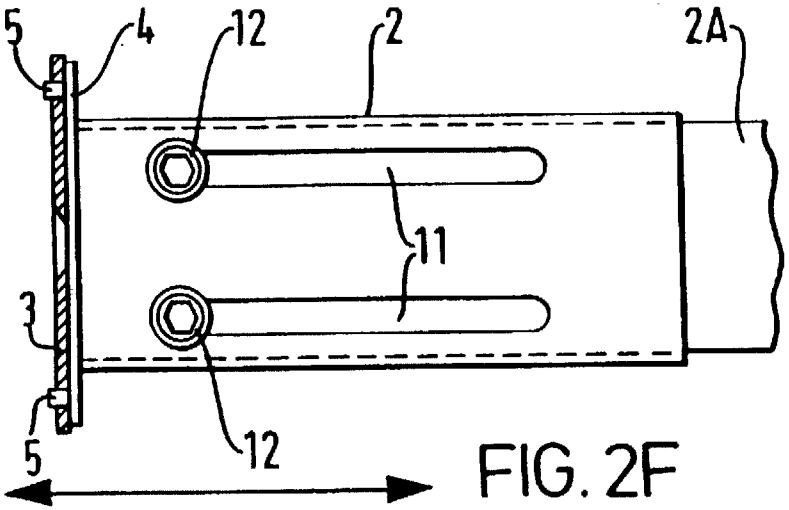
Figure 2E:
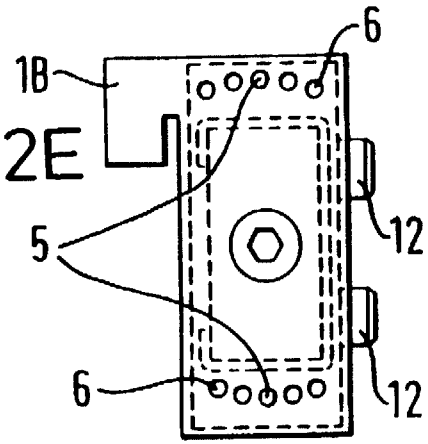

FIGS. 2E and 2F show a modified main support section 2 to that shown in FIG. 1 in that its length can be varied. The illustrated main support section comprises two tubular sections 2 and 2A, the section 2A fitting inside the section 2. The section 2 is formed with a pair of spaced parallel longitudinal slots 7 which receive bolts 12 threadingly fitted to the main support section 2A. It can be seen therefore that the length of the main support section 2, 2A can be varied by moving the two parts 2, 2A relative to each other longitudinally whereby the bolts 12 slide along the slots 7. Tightening the bolts 12 fixes the position of the section 2 relative to the section 2A.

Figure 3:
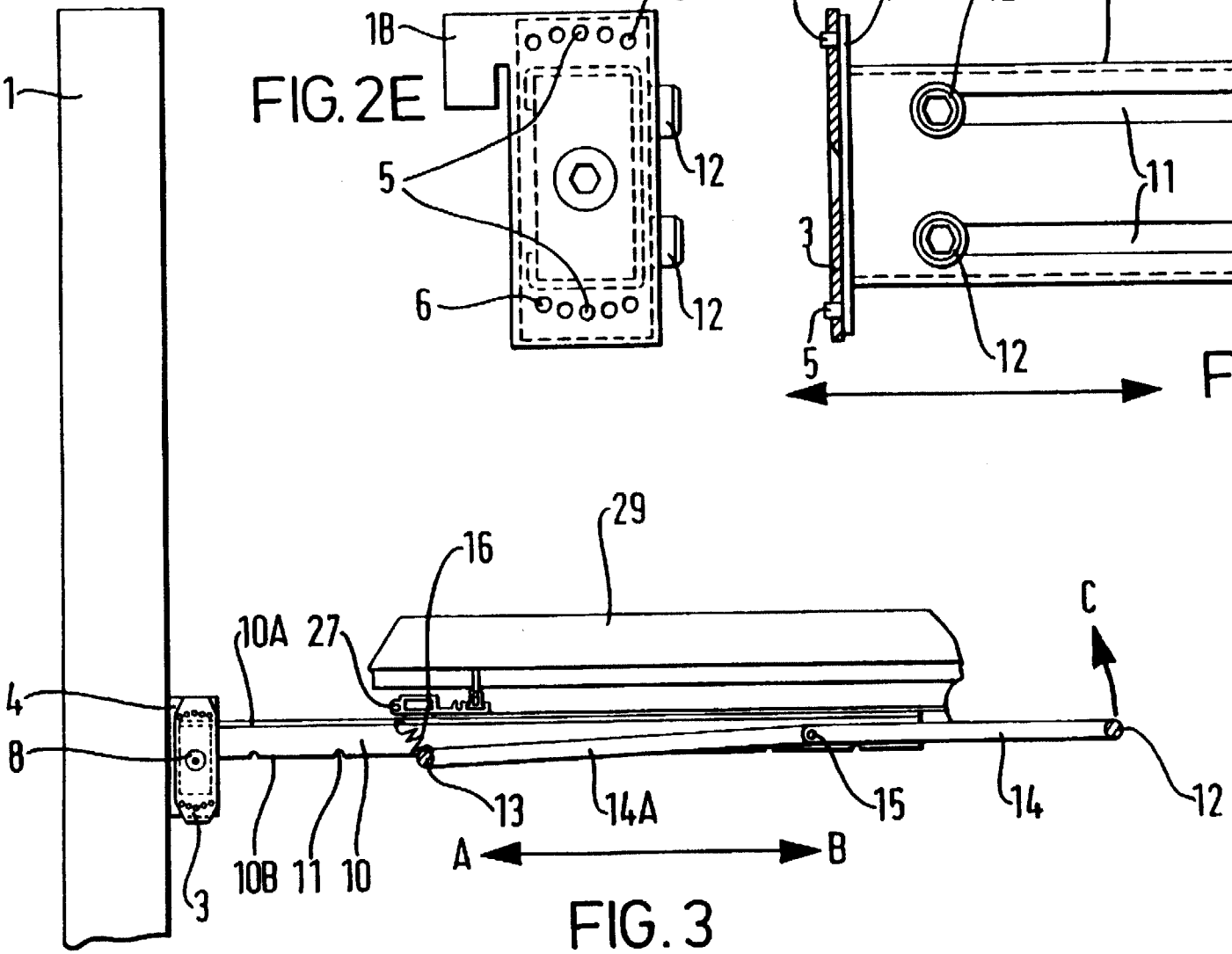
FIG. 3 is a side view of the pull-out shelf assembly shown in FIG. 1.
Figure 3A:
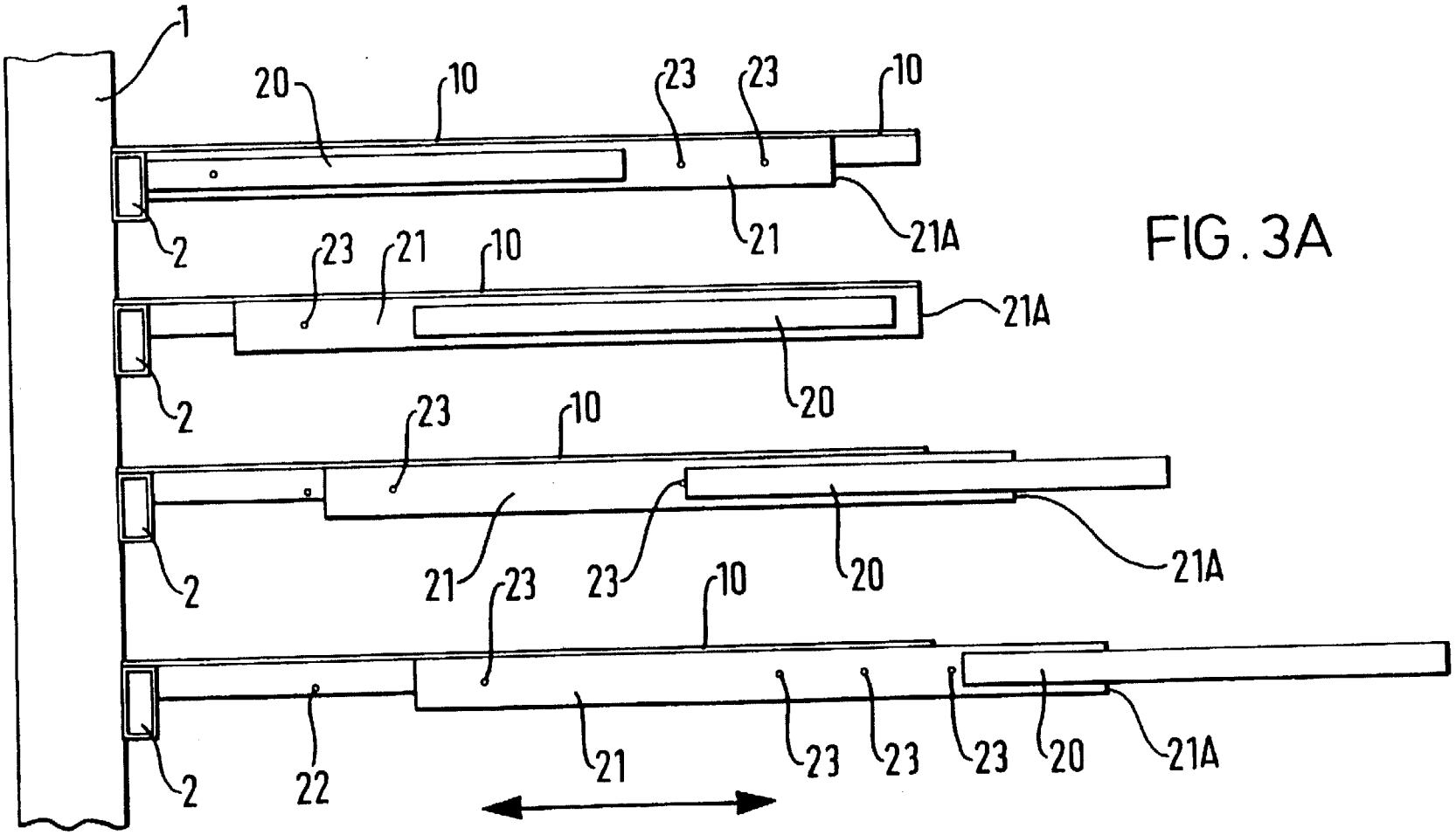
FIG. 3A is a schematic view showing the shelf runner assembly attached to the shelf support means in various different longitudinal locations relative thereto.

Referring now to FIGS. 3 and 3A, there is shown in more detail the pull-out facility provided on the shelf assemblies shown in FIG. 1. Each shelf assembly comprises a shelf support means or arm 10 secured to the main support section 2 attached to the slotted uprights 1. An angular adjustment facility comprising the cooperating plates 3, 4 and pegs 5 is provided at one end of the shelf support arms 10 but this is optional. The bottom edge of each arm 10 is provided with incrementally spaced detents 11. An extendable runner assembly is attached to each shelf support arm 10 and comprises a movable running rail 20 and a fixed member or guide rail 21.

Each support arm 10 is provided with runner assembly mounting means thereon which in the arrangement shown in FIG. 3A comprises several spaced holes 22 (only one is visible) along the length of the arm 10. A series of corresponding spaced holes 23 is formed in the fixed member 21 of the extendable runner assembly. It will be appreciated therefore that the fixed member 21 of the guide rail assembly can be mounted on its support arm 10 in any one of several different longitudinal locations such as the four shown in FIG. 3A whereby, in each case, the end 21A of the fixed runner member 21 projects further than the runner located immediately above it thereby providing a cascade effect for the shelves supported by the arms 10. In each case, the movable runner rail 20 can be extended forwardly by all of its available length of travel so each shelf can be fully stocked with product regardless of the cascading shelf arrangement.

Instead of using a series of aligned holes 22, 23, cooperating slots or some other means can be used to provide this same longitudinal adjustment facility for the mounting of the extendable runner assembly on each support arm 10.

Figure 4:
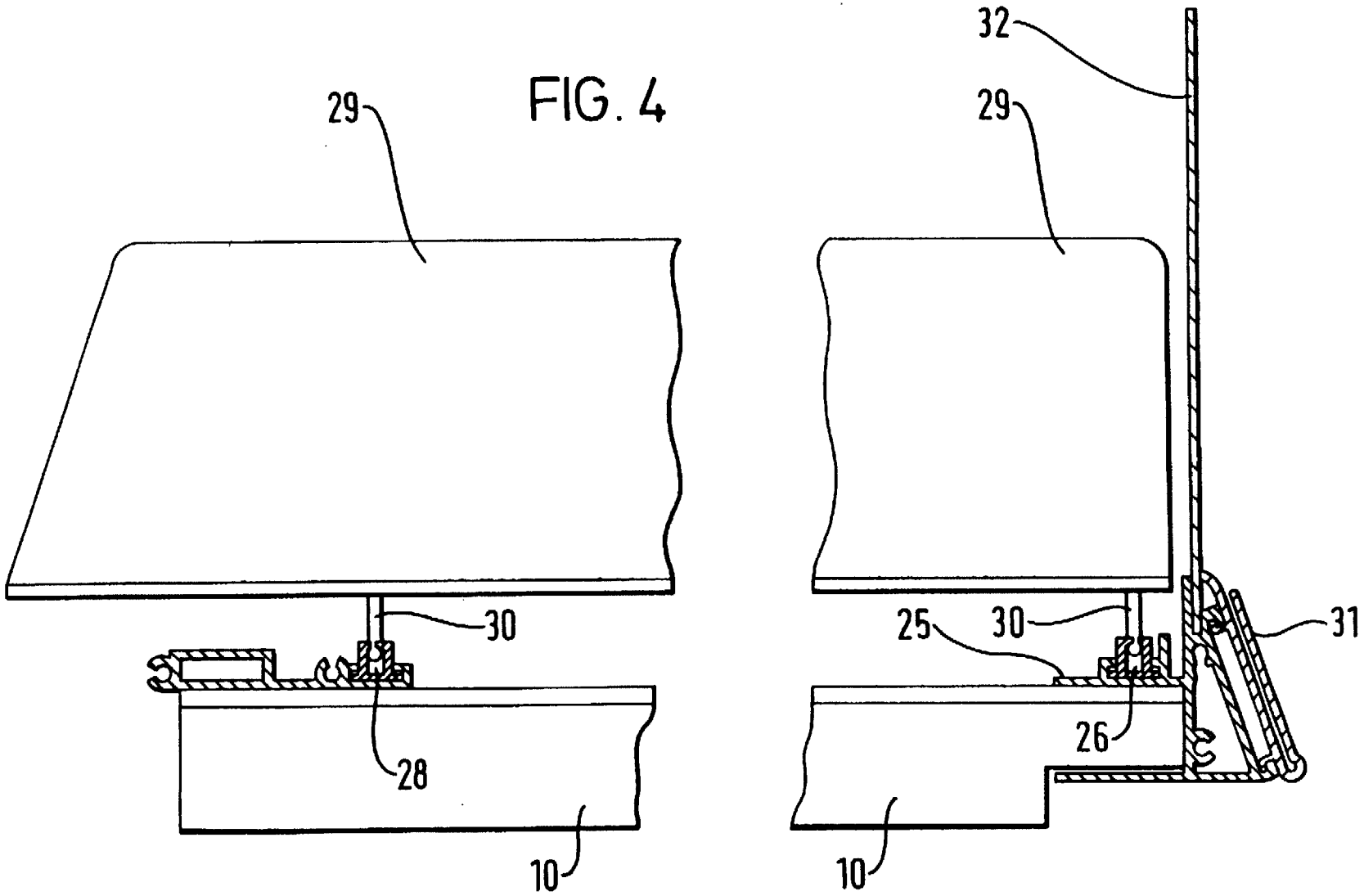
FIG. 4 is a cross section through one of the shelf assemblies shown in FIG. 1.

FIG. 4 shows front shelf rail 25 and rear shelf rail 27 (preferably metal or plastic extrusions) with dividers 29 having downwardly projecting feet 30 which are fitted into slots 26 and 28 provided respectively along the whole length of the front and rear rails 25, 27. Thus, the dividers 29 can be slid along the slots 26, 28 to vary their position along the length of the shelf assembly. Instead of a single wall shelf divider 29 as shown in FIG. 4, an end stop 37 which slides in a longitudinal slot in a base portion 36 can be used (see FIG. 1). The front rail 25 can include a portion which receives a label holder 31 and also an upstanding front shelf edge 32.

Referring now to the embodiment of FIGS. 1 and 3, it can be seen that a locking mechanism is provided on the shelf assembly which comprises a pair of lever arms 14 pivotally attached at 15 to the extendable runner assembly 20, 21. An activator bar 12 extends between the spaced lever arms 14 just beneath the front edge of the shelf assembly. It should be noted in the FIG. 3 illustration that only part of the shelf assembly is shown so the actuator bar appears to project forwardly of the front edge. This is not in fact the case, as can be better seen from FIG. 1. A locking bar 13 is provided at the other inward end of the lever arms 14 and this is arranged to engage in the detents 11. It will be noted that each lever arm 14 has an end section 14A which is cranked slightly downwardly to assist in the locking engagement of the locking bar 13 in the detents 11. A spring 16 biases the locking bar 13 into engagement with the detents 11 in normal use. In order to extend the shelf in the direction of the arrows A or B in FIG. 3, the actuator bar 12 is raised in the direction of the arrow C and it will be seen that this results in the locking bar 13 moving downwardly out of engagement with the detent 11. Thus, the shelf assembly supported by the extendable rails 20, 21 can be moved in either direction indicated by the arrow until the locking bar engages in the next detent 11. I f further inward or outward movement of the shelf assembly is required, then the actuator bar 12 is again released so that the locking bar 13 can move to engage the next detent 11.

It will be seen from the foregoing description that the locking mechanism provided on the shelf assembly shown in FIGS. 3 and 3A is extremely simple to operate and allows it to be readily moved inwardly or outwardly relative to the uprights 1 by fixed incremental distances and then locked in position.

In some circumstances, it may be undesirable to have the locking lever 14 project below the bottom edge of the support arm 10 as shown in FIG. 3 due to space limitations between adjacent shelves so the operating mechanism for the lever 14 can be redesigned so that the free end of the lever engages in holes provided in upper wall 10A of the support arm 10, the lever being spring biased to normally engage said holes by means reacting between said upper wall 10A and the lever. With such an arrangement, when the lever 14 is raised in the direction of arrow C to release the engagement between it and the holes 10A, it will not protrude beyond the bottom edge 10B of the support arm 10 and catch or foul on product stacked on a shelf (not shown) located immediately beneath it.

What is claimed is:

1. An angularly adjustable and extendable shelf assembly adapted to be removably mounted on slotted uprights of a merchandising display stand comprising a shelf mounted on shelf support means, shelf angle adjusting means between the shelf and the slotted uprights for enabling the angular orientation of the shelf to be selectively adjusted, shelf extending means attached to said shelf and the shelf support means and operable so that the shelf can be extended or retracted, and manually operable locking means operable to permit the shelf to be incrementally extended or retracted to a selected one of several incrementally spaced positions between rear and forward positions of the shelf when the locking means are released, said locking means retaining the shelf in its selected position when re-engaged.

2. An extendable shelf assembly according to claim 1 wherein the shelf extension means comprises at least one extendable runner assembly with a fixed member and a movable runner movably mounted thereon, the fixed member being attached to the shelf support means and the movable runner being attached to the shelf, the movable member being mounted so as to be extendable from and retractable within the fixed member.

3. An extendable shelf assembly according to claim 1 wherein the locking means is mounted on the extendable shelf and engages with the shelf support means to retain the shelf in a selected position.

4. An extendable shelf assembly according to claim 1 wherein the shelf support means has a plurality of incrementally spaced detents thereon engagable by the locking means to retain the shelf in a selected horizontal position.

5. An extendable shelf assembly according to claim 4 wherein the shelf support means comprises a pair of spaced support arms with the spaced detents formed along the underside thereof.

6. An extendable shelf assembly according to claim 4 wherein the locking means includes a movable actuator bar located underneath and adjacent the front edge of the shelf assembly, said bar being movable to disengage the locking means from the detents so that the shelf can be moved relative to the shelf support means.

7. An extendable shelf assembly according to claim 6 wherein the locking means comprises a locking bar connected to the actuator bar and engagable with the detents.

8. An extendable shelf assembly according to claim 7 wherein the locking bar is normally biased into engagement with the detents.

9. An extendable shelf assembly according to claim 7 wherein the locking bar extends between a pair of lever arms connected to the actuator bar, such lever arm being pivotally mounted to the adjacent movable runner intermediate its ends.

10. An extendable shelf assembly according to claim 1 wherein the locking means comprises a pivotally mounted locking lever associated with said shelf support means which is normally biased into engagement with a selected hole of a plurality of holes provided at spaced increments along the length of said shelf support means.

11. An extendable shelf assembly according to claim 10 wherein the shelf is supported on a pair of shelf support means each having a locking lever operably associated therewith.

12. An extendable shelf assembly according to claim 11 wherein the locking levers are operable independently of each other.

13. An extendable shelf assembly according to claim 1 wherein the shelf includes a front and rear rail and at least one shelf divider being slidably mounted for movement along said rails.

14. An extendable shelf assembly according to claim 13 wherein each shelf divider has a product support member mounted thereon to slide along the length of said divider.

15. An extendable shelf assembly according to claim 14 wherein the product support member is biased for movement towards the front of said divider.

16. An extendable shelf assembly according to claim 1 wherein the shelf support means includes mounting means adapted to permit the extended position of the fixed member of the runner assembly on the support means to be varied.

17. An extendable shelf assembly according to claim 16 wherein the mounting means is a series of spaced holes.

18. An extendable shelf assembly according to claim 17 wherein the mounting means is a longitudinally extending slot.

19. An extendable shelf assembly according to claim 1 wherein the angularly adjustable shelf support assembly comprises a first mounting member releasably attached to one of the slotted uprights, and a second mounting member attachable to the shelf, said first and second mounting members having cooperating pegs and holes thereon by means of which the angular orientation of the second member relative to the first member can be changed and securing means to hold the first and second mounting members together in selected angular orientation.

20. An extendable shelf assembly according to claim 19 wherein the first and second mounting members are flat plates.

21. An extendable shelf assembly according to claim 19 wherein the cooperating holes and pegs are arranged on the first and second mounting members around a central pivot axis about which the second member pivots.

* * * * *